US011213176B2

(12) United States Patent
Lv

(10) Patent No.: US 11,213,176 B2
(45) Date of Patent: Jan. 4, 2022

(54) GLASS-WIPING ROBOT

(71) Applicant: ECOVACS ROBOTICS CO., LTD., Suzhou (CN)

(72) Inventor: Xiaoming Lv, Suzhou (CN)

(73) Assignee: ECOVACS ROBOTICS CO., LTD., Suzhou (CN)

( * ) Notice: Subject to any disclaimer, the term of this patent is extended or adjusted under 35 U.S.C. 154(b) by 56 days.

(21) Appl. No.: 16/863,887

(22) Filed: Apr. 30, 2020

(65) Prior Publication Data

US 2020/0253434 A1 Aug. 13, 2020

Related U.S. Application Data

(63) Continuation of application No. 14/431,625, filed as application No. PCT/CN2013/084580 on Sep. 29, 2013, now Pat. No. 10,799,079.

(30) Foreign Application Priority Data

Sep. 29, 2012 (CN) ..... 201210375133.8

(51) Int. Cl.

| | |
|---|---|
| ***A47L 3/00*** | (2006.01) |
| ***A47L 1/02*** | (2006.01) |
| ***A47L 1/03*** | (2006.01) |

(52) U.S. Cl.

CPC ..... *A47L 3/00* (2013.01); *A47L 1/02* (2013.01); *A47L 1/03* (2013.01); *A47L 2201/00* (2013.01)

(58) Field of Classification Search

CPC ..... A47L 3/00; A47L 1/02; A47L 1/03; A47L 2201/00

See application file for complete search history.

(56) References Cited

U.S. PATENT DOCUMENTS

| | | | |
|---|---|---|---|
| 5,965,994 | A | 10/1999 | Seo |
| 6,691,811 | B2 | 2/2004 | Bruntrup et al. |
| 7,313,840 | B2 | 1/2008 | Watkins |
| 8,127,390 | B2 | 3/2012 | Kim |
| 2003/0009844 | A1 | 1/2003 | Bruntrup et al. |

(Continued)

FOREIGN PATENT DOCUMENTS

| | | | |
|---|---|---|---|
| CN | 2055817 | U | 4/1990 |
| CN | 2202495 | Y | 7/1995 |
| CN | 2353304 | Y | 12/1999 |

(Continued)

OTHER PUBLICATIONS

Extended European Search Report from EP application No. 13841329.9 dated Sep. 16, 2012.

(Continued)

*Primary Examiner* — Andrew A Horton
(74) *Attorney, Agent, or Firm* — Maschoff Brennan

(57) ABSTRACT

The present invention relates to the technical field of manufacturing of small appliances, and relates to a glass-wiping robot. The glass-wiping robot comprises a robot main body, a power cord and a safety buckle. The power cord is connected to the robot main body, and winds onto the safety buckle. The safety buckle is provided thereon with a suction cup. The safety buckle sucks on a glass via the suction cup. The glass-wiping robot of the present invention provides double protection and improved safety effects when the robot main body inadvertently falls off the window, allows for convenient fixing or moving of the safety buckle, and is convenient to carry.

10 Claims, 2 Drawing Sheets

(56) References Cited

U.S. PATENT DOCUMENTS

| | | | |
|---|---|---|---|
| 2003/0033684 | A1 | 2/2003 | Konrad |
| 2004/0246387 | A1 | 12/2004 | Horiuchi |

FOREIGN PATENT DOCUMENTS

| | | | |
|---|---|---|---|
| CN | 2432881 | Y | 6/2001 |
| CN | 2882055 | Y | 3/2007 |
| CN | 201253616 | Y | 6/2009 |
| CN | 201324210 | Y | 10/2009 |
| CN | 101626873 | A | 1/2010 |
| CN | 201542554 | U | 8/2010 |
| CN | 201775608 | U | 3/2011 |
| CN | 201977716 | U | 9/2011 |
| CN | 202051655 | U | 11/2011 |
| CN | 202096151 | U | 1/2012 |
| CN | 202843504 | U | 4/2013 |
| DE | 19958890 | C1 | 2/2001 |
| JP | 53-098074 | A | 8/1978 |
| JP | 08140899 | A | 6/1996 |
| JP | 2000-250452 | A | 9/2000 |
| JP | 2004-141519 | A | 5/2004 |
| WO | 2008096974 | A1 | 8/2008 |
| WO | 2014183638 | A1 | 11/2014 |

OTHER PUBLICATIONS

International Search Report and Written Opinion dated Jan. 16, 2014 issued in corresponding International Patent Application No. PCT/CN2013/084580.

KR office action in application No. 10-2015-7010933 dated Jun. 24, 2019.

KR office action in application No. 10-2015-7010933 dated Oct. 29, 2019.

CN office action in application No. 201210375133.8 dated Jul. 28, 2015.

CN office action in application No. 201210375133.8 dated Apr. 19, 2016.

CN office action in application No. 201210375133.8 dated Apr. 25, 2017.

CN office action in application No. 201210375133.8 dated Oct. 25, 2016.

International Search Report in PCT application No. PCT/CN2013/084580 dated Jan. 16, 2014.

Written Opinion in PCT application No. PCT/CN2013/084580 dated Jan. 16, 2014.

GLASS-WIPING ROBOT

FIELD OF THE INVENTION

The present invention relates to the technical field of manufacturing of small appliances, and particularly relates to a glass-wiping robot.

BACKGROUND ART

For a glass-wiping robot available in the market, the body thereof is usually connected to a power cord for supplying power to the operating of the glass-wiping robot. Generally, the other end of the power cord is connected to a safety buckle, and the safety buckle is stuck between the glass and the frame in order to prevent the glass-wiping robot from being damaged by accidental falling. However, the machine may sway during falling, and the window may be pushed open when the glass-wiping robot sways to the side of the glass, resulting in that the safety buckle cannot be stuck between the glass and the frame and then falls off together with the glass-wiping robot. Or, the glass may be accidentally opened by the user due to his/her negligence, and the safety buckle may also escape from the glass and the frame, and fall off together with the robot, which will damage the glass-wiping robot or cause unexpected dangers.

SUMMARY OF THE INVENTION

It is a technical objective of the present invention to provide a glass-wiping robot having a safety buckle with a suction cup to overcome the deficiencies in the prior art. The disclosed glass-wiping robot can effectively prevent the robot from accidental falling, and is convenient to carry.

The technical objective of the present invention is realized through the following technical solutions:

A glass-wiping robot comprises a robot main body, a power cord and a safety buckle, wherein the power cord is connected to the robot main body and winds onto the safety buckle, and the safety buckle is provided with a suction cup through which the safety buckle sucks on the glass.

Further, the safety buckle comprises a first end face and a second end face connected by a central pillar, and at least one of the first and second end faces is provided with a first threading hole and a second threading hole.

When the suction cup is provided at the first end face, the power cord threads into the first threading hole of the second end face, and winds on the central pillar, and then threads out the second threading hole of the second end face.

When the suction cup is provided at the second end face, the power cord threads into the first threading hole of the first end face, and winds on the central pillar, and then threads out the second threading hole of the first end face.

A through hole is provided at the center of the central pillar for facilitating the threading.

Preferably, the first threading hole and the second threading hole are axisymmetrically provided with respect to the central pillar.

The glass-wiping robot with a safety buckle of the present invention has the following advantages:

When inadvertently falling off the window, the glass-wiping robot of the present invention provides double protection and improved safety effects. On one hand, the suction cup can bear the weight of the safety buckle, which serves as the first protection. On the other hand, if the suction cup fails, the safety buckle will still be stuck between the glass and the frame, which serves as the second protection.

The glass-wiping robot of the present invention is convenient to carry, since it allows for conveniently fixing or moving the safety buckle.

DESCRIPTION OF ATTACHED DRAWINGS

DESCRIPTION OF REFERENCE NUMBERS IN THE FIGURES

Figure 1:
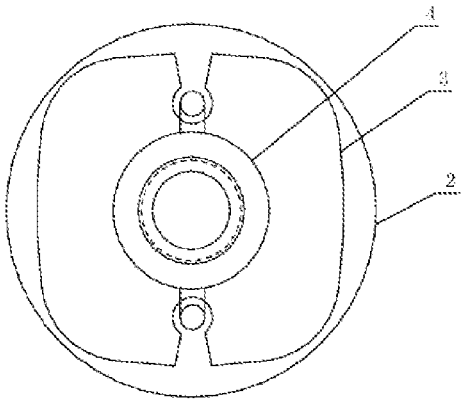
FIG. 1 is a schematic illustration of a part of the structure of a glass-wiping robot with a safety buckle according to the present invention.

1. robot main body 2. suction cup 3. safety buckle
4. power cord 5. Glass 31. first end face
32. second end face 33. central pillar 331. through hole
311. a first threading hole of the first end face
312. a second threading hole of the first end face
321. a first threading hole of the second end face
322. a second threading hole of the second end face

DETAILED DESCRIPTION OF PREFERRED EMBODIMENTS

The present invention is further described in detail with reference to the drawings and embodiments.

FIG. 1 is schematic illustration of a part of the structure of a glass-wiping robot with a safety buckle according to the present invention. The part of the structure comprises a safety buckle 3 with a suction cup 2 thereon and a power cord 4 winding into the safety buckle 3.

Figure 2:
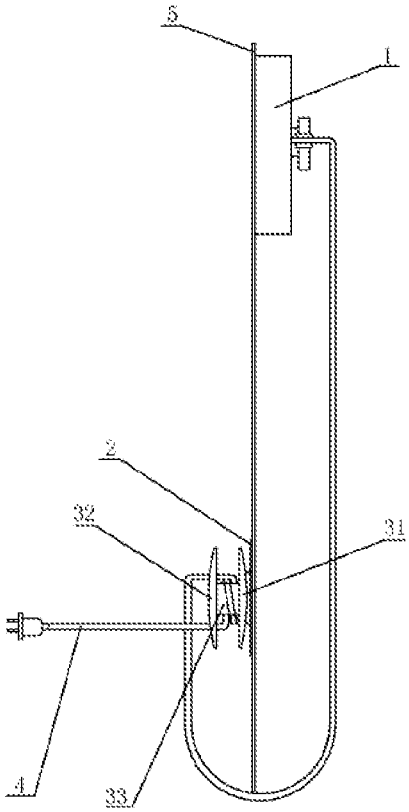
FIG. 2 is a schematic illustration of a glass-wiping robot with a safety buckle (a suction cup is provided on a first end face) sucking on a glass, according to the present invention.
Figure 3:
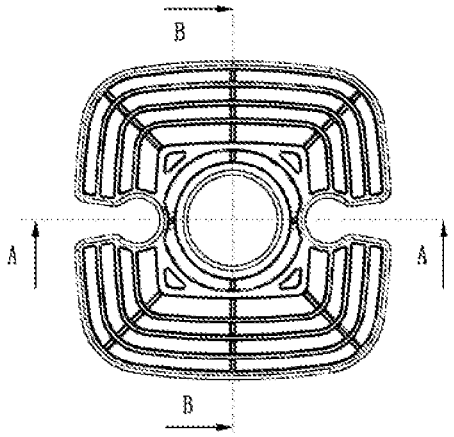
FIG. 3 is a top view of a safety buckle of the present invention.
Figure 5:
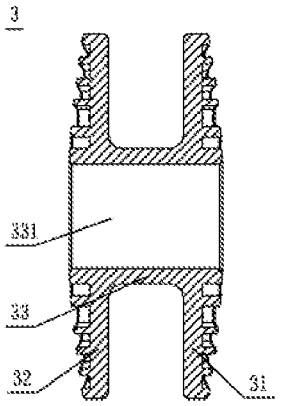
FIG. 5 is a cross-sectional view along line B-B of FIG. 3.
Figure 4:
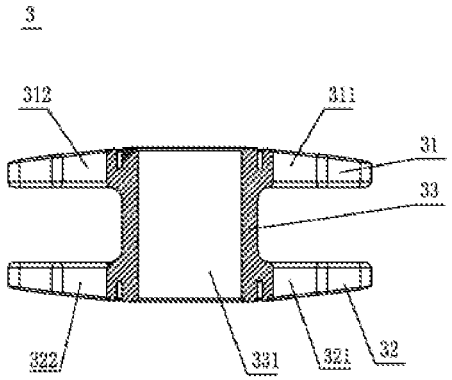
FIG. 4 is a cross-sectional view along line A-A of FIG. 3.
Figure 6:
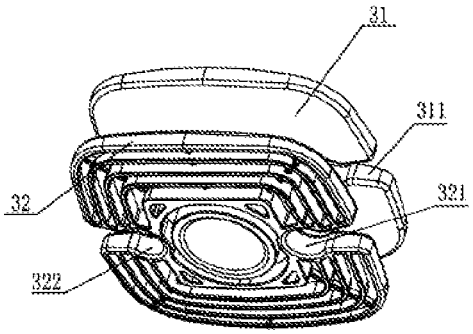
FIG. 6 is a perspective view of a safety buckle of the present invention.

FIG. 2 is a schematic illustration of a glass-wiping robot with a safety buckle (a suction cup is provided on a first end face) sucking on the glass, according to the present invention; FIG. 3 is a top view of the safety buckle; and FIG. 6 is a perspective view of the safety buckle. As shown in FIGS. 2 and 3 with reference to FIG. 6, a glass-wiping robot comprises a robot main body 1, a power cord 4 and a safety buckle 3, the power cord 4 is connected to the robot main body 1, a part of the power cord 4 winds onto the safety buckle, and the safety buckle 3 is provided with a suction cup 2 thereon to suck the safety buckle 3 on a glass 5. The suction force of the suction cup can at least bear the weight of the safety buckle 3 and the power cord 4 winding onto the safety buckle, which facilitates the safety buckle to be conveniently fixed on the glass. Preferably, the suction force of the suction cup can also support the weight of the glass-wiping robot body. In this way, the prevention of the glass-wiping robot from accidental falling can be better. The suction cup is adopted to suck and fix the safety buckle on the glass, such that the safety buckle is convenient to use and to carry.

The falling prevention principle of the safety buckle with the suction cup is described below in detail with reference to FIG. 2.

When the glass-wiping robot main body 1 inadvertently falls off a window, it can be well prevented from being damaged upon falling due to the suction cup 2, if the suction force of the suction cup 2 is greater than the impact force of the glass-wiping robot main body 1 when falling. While if the suction force of the suction cup 2 is not enough to resist the great impact force of the glass-wiping robot main body 1 when falling, and the suction cup 2 together with the safety buckle 3 separates from the glass 5, the suction cup 2 and the safety buckle 3 can still be stuck in the gap of the glass and the frame, which serves as a second protection. Particularly, the suction cup 2 together with the safety buckle 3 is fixed on the window glass 5 by sucking on the glass, and the window will not be pushed open by the sway of the power cord 4, even if a greater pushing force is applied to the window glass 5 when the falling glass-wiping robot main body 1 sways to the lowest point. This is because the suction cup 2 sucks on the glass 5 such that the suction cup 2 and the glass 5 become a whole. That is, although the power cord 4 applies a side pushing force on the window, the suction force of the suction cup 2 pulls glass 5 towards the frame, and the two forces are neutralized so that the window glass is hardly be pushed open. Further, the suction force of the suction cup 2 on glass 5 can effectively release the great impact force generated by the falling of the glass-wiping robot main body 1. When the suction cup 2 and the safety buckle 3 are stuck in the gap between the glass 5 and the frame after falling off the glass 5, the impact force of the swaying glass-wiping robot main body 1 is subsequently and correspondingly reduced, resulting in that the window glass is hardly pushed open. In this case, the following situation occurred if only the safety buckle 3 stuck between the glass 5 and the frame is used can be effectively prevented: when the glass 5 is pushed by a sway pushing force or other factors, the safety buckle 3 will escape from the glass 5 and the frame, resulting in the damage of the glass-wiping robot main body 1.

As shown in FIG. 2 to FIG. 5, the safety buckle 3 comprises a first end face 31 and a second end face 32 that have the same shape and are connected by a central pillar 33. The central pillar 33 has a certain length and forms a stuck section between the first end face 31 and the second end face 32, and the stuck section is configured to be stuck between the glass 5 and frame. A first threading hole and a second threading hole are provided on at least one end face of the first end face 31 and the second end face 32 to facilitate wire wrapping. Obviously, first threading holes 311, 321 and second threading holes 312, 322 may be symmetrically provided on the first end face and the second end face, respectively. Preferably, the first threading hole and the second threading hole are axisymmetrically provided with respect to the central pillar 33. Further, a through hole 331 may be provided at the center of the central pillar 33A, which may be used for threading.

When the suction cup 2 is provided at the first end face 31, the power cord 4 threads into the first threading hole 321 of the second end face 32, and winds on the central pillar 33, and then threads out the second threading hole 322 of the second end face 32.

In another example, the suction cup 2 may be provided at the second end face 32. In this case, the power cord 4 threads into the first threading hole 311 of the first end face 31, and winds on the central pillar 33, and then threads out the second threading hole 312 of the first end face 31.

When cleaning a glass in practice, the glass-wiping robot body is disposed at the outer side of the glass for the cleaning work, the safety buckle with a suction cup sucks on the inner side of the glass, and there is only a gap between the glass and the frame for the power cord to pass through. It is to be noted that the power cord of the present invention shall be comprehended as comprising a safety rope or a safety power rope, or other ropes for preventing the glass-wiping robot from accidental falling. The shape of the safety buckle and the manner of winding a wire on the safety buckle are not limited to those described in the above embodiments, and all glass-wiping robots having the structure of a safety buckle with a suction cup should fall into the scope of the claims of the present invention.

What is claimed is:

1. A glass-wiping robot comprising:
a robot main body,
a power cord connected to the robot main body and
a safety buckle wound by the power cord,
wherein:
the safety buckle is provided with a suction cup thereon for sucking the safety buckle onto a glass;
the safety buckle includes a first end face and a second end face connected by a central pillar; and
a stuck section is formed between the first end face and the second end face; and
wherein when the suction cup fails, the stuck section is stuck between the glass and a frame.

2. The glass-wiping robot of claim 1, wherein at least one of the first face and the second end face is provided with a first threading hole and a second threading hole.

3. The glass-wiping robot of claim 2, wherein the suction cup is provided at the first end face, and the power cord threads into the first threading hole of the second end face, and winds on the central pillar, and then threads out the second threading hole of the second end face.

4. The glass-wiping robot of claim 2, wherein the suction cup is provided at the second end face, and the power cord threads into the first threading hole of the first end face, and winds on the central pillar, and then threads out the second threading hole of the first end face.

5. The glass-wiping robot of claim 2, wherein the first threading hole and the second threading hole are axisymmetrically provided with respect to the central pillar.

6. The glass-wiping robot of claim 1, wherein a through hole is provided at the center of the central pillar.

7. The glass-wiping robot of claim 1, wherein in a glass cleaning, the robot main body is disposed at a first side of the glass, and the suction cup sucks on a second side of the glass; and wherein the first side of the glass is opposite to the second side of the glass.

8. The glass-wiping robot of claim 7, wherein the first side of the glass is an outer side of the glass and the second side of the glass is an inner side of the glass.

9. A glass cleaning system, comprising,
a glass-wiping robot, and
a glass;
wherein:
the glass-wiping robot includes:
a robot main body,
a power cord connected to the robot main body, and
a safety buckle wound by the power cord,
the safety buckle is provided with a suction cup thereon for sucking the safety buckle onto a glass;
the safety buckle includes a first end face and a second end face connected by a central pillar;
a stuck section is formed between the first end face and the second end face, and
when the suction cup fails, the stuck section is stuck between the glass and a frame.

10. A glass cleaning method, wherein a glass-wiping robot includes a robot main body, a power cord connected to the robot main body and a safety buckle wound by the power cord, and wherein the safety buckle is provided with a suction cup thereon for sucking the safety buckle onto a glass, the method comprising:

disposing the robot main body at a first side of the glass; and sucking the suction cup on a second side of the glass;

wherein the first side of the glass is opposite to the second side of the glass, such that the glass is prevented from being pushed open when the robot main body accidentally falls off the glass; and when the suction cup fails, a stuck section formed between a first end face of the safety buckle and a second end face of the safety buckle is stuck between the glass of a frame, such that the glass-wiping robot is prevented from being damaged when the robot main body accidentally falls.

* * * * *